US006508551B1

(12) United States Patent
Snyder

(10) Patent No.: US 6,508,551 B1
(45) Date of Patent: Jan. 21, 2003

(54) CONTROLLING TRANSPARENCY HAZE USING A SOFT DRUM

(75) Inventor: Trevor J. Snyder, Newberg, OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/000,339

(22) Filed: Dec. 4, 2001

(51) Int. Cl.[7] ..... B41J 2/01
(52) U.S. Cl. ..... 347/102
(58) Field of Search ..... 347/102, 101, 347/104, 105, 106, 107, 43, 4; 399/320; 346/25; 219/216; 101/488; 34/304, 381

(56) References Cited

U.S. PATENT DOCUMENTS 5,389,958 A 2/1995 Bui et al. ..... 347/103
5,805,191 A 9/1998 Jones et al. ..... 347/103
6,196,675 B1 3/2001 Delly et al. ..... 347/103

*Primary Examiner*—Raquel Yvette Gordon
(74) *Attorney, Agent, or Firm*—Philip T. Virga

(57) ABSTRACT

An application system is described for applying a two-step transfix process whereby an ink image is applied onto an intermediate transfer surface and then transferred to a receiving substrate, followed re-transfixing the ink image by pulling the receiving medium back through a duplex path. The system includes an applicator assembly for uniformly distributing a liquid layer onto a support surface defining an elastomer release surface to produce the intermediate transfer surface. The system uses the elastomer transfer surface in combination with a hard drum for near perfect image transfer of the ink image onto the receiving substrate wherein lensing of the ink image is greatly reduced.

20 Claims, 3 Drawing Sheets

CONTROLLING TRANSPARENCY HAZE USING A SOFT DRUM

CROSS REFERENCE TO RELATED APPLICATIONS

Attention is directed to copending applications Ser. No. 10/000,345 , filed herewith, entitled, "Controlling Gloss in an Offset Ink Jet Printer" and Ser. No. 10/000,336 , filed herewith, entitled, "Continuous Transfer and Fusing Application System." The disclosure of these references is hereby incorporated by reference in their entirety.

FIELD OF INVENTION

The present invention relates generally to an imaging process. More specifically, the invention relates to an application system for applying a two-step transfix process whereby a hot melt ink is applied onto an elastomer transfer surface and then transferred to a receiving substrate, followed by re-transfixing the hot melt ink by pulling the receiving substrate through a duplex path.

BACKGROUND OF THE INVENTION

For printing in a solid-ink printer, a common method of applying droplets of ink onto a piece of paper is to directly print the image onto the paper, i.e., a process known as direct printing. However, direct printing has many disadvantages. First, the head to paper gap must be adjusted for different media in order to control drop position. Second, there is the well-known paper hand-off problem between the rollers that guide the paper, because of the large size of the head. Third, there is a concern that head reliability will decrease because the paper is near the head. Also, to maximize print speed, many direct print architectures deposit the image bi-directional, which introduces image artifacts and color shifts. These problems are addressed with an offset process. In this process, the ink is first applied to a rotating drum and is then transferred off the drum and fixed into the paper in a single pass. This process is known as a transfix process or a transfuse process. Therefore, a single drum surface transfers the image, spreads the pixels, penetrates the pixels into the media, and controls the topography of the ink to increase paper gloss and transparency haze. The process requires a delicate balance of drum temperature, paper temperature, transfix load, and drum and transfix roller materials and properties in order to achieve image quality. These combined requirements reduce the drum material possibilities mainly due to wear of weaker materials, which result in gloss and haze degradation. There are also undesired print and image quality trade-offs, which must be made when optimizing a printer for customer usage. For instance, between good gloss versus good image transfer.

Ink jet printing systems utilizing intermediate transfer ink jet recording methods, such as that disclosed in U.S. Pat. No. 5,389,958 entitled IMAGING PROCESS and assigned to the assignee of the present application (the '958 patent) is an example of an indirect or offset printing architecture that utilizes phase change ink. A release agent application defining an intermediate transfer surface is applied by a wicking pad that is housed within an applicator apparatus. Prior to imaging, the applicator is raised into contact with the rotating drum to apply or replenish the liquid intermediate transfer surface.

Once the liquid intermediate transfer surface has been applied, the applicator is retracted and the print head ejects drops of ink to form the ink image on the liquid intermediate transfer surface. The ink is applied in molten form, having been melted from its solid state form. The ink image solidifies on the liquid intermediate transfer surface by cooling to a malleable solid intermediate state as the drum continues to rotate. When the imaging has been completed, a transfer roller is moved into contact with the drum to form a pressurized transfer nip between the roller and the curved surface of the intermediate transfer surface/drum. A final receiving substrate, such as a sheet of media, is then fed into the transfer nip and the ink image is transferred to the final receiving substrate.

To provide acceptable image transfer and final image quality, an appropriate combination of pressure and temperature must be applied to the ink image on the final receiving substrate. U.S. Pat. No. 6,196,675 entitled APPARATUS AND METHOD FOR IMAGE FUSING and assigned to the assignee of the present application (the '675 patent) discloses a roller for fixing an ink image on a final receiving substrate. The preferred embodiment of the roller is described in the context of an offset ink jet printing apparatus similar to the one described in the '958 patent. In this embodiment, an apparatus and related method for improved image fusing in an ink jet printing system are provided. An ink image is transferred to a final receiving substrate by passing the substrate through a transfer nip. The substrate and ink image are then passed through a fusing nip that fuses the ink image into the final receiving substrate. Utilizing separate image transfer and image fusing operations allows improved image fusing and faster print speeds. The secondary fusing operation enables the image transfer process to use reduced pressures, whereby the load on the drum and transfer roller is reduced. However, while the simultaneous transfer and fusing outlined in this architecture has many advantages, the separate fuser does necessitate the requirement for additional components, i.e., the fuser system. Additional components offer greater flexibility in print and image quality and print speed; however, it also leads to higher cost, complexity and weight. For some markets, such as the consumer market, the design is driven more by cost than print speed and so the addition of a separate fuser is cost prohibitive. Therefore what is needed is a transfer surface application system that achieves the benefits of the separate transfer and fuse architecture without the drawbacks of previous application systems using a separate fusing mechanism.

SUMMARY OF THE INVENTION

It is an object of the present invention to provide an improved imaging method and apparatus which allows high quality imaging on a variety of transparency media wherein lensing of an image is greatly reduced, which reduces haze in transparencies.

It is an object of the present invention to provide an improved imaging method and apparatus which allows high quality imaging on a variety of paper wherein the gloss of the media is greatly increased.

It is another object of the present invention to provide an improved imaging apparatus and method for a combination soft drum and hard roller for near perfect image transfer.

Accordingly, the present invention is an application system for applying a two-step transfix process whereby an ink image is applied onto an intermediate transfer surface and then transferred to a receiving substrate, followed re-transfixing the ink image by pulling the receiving medium back through a duplex path. The system includes an applicator assembly for uniformly distributing a liquid layer onto a support surface defining an elastomer release surface to produce the intermediate transfer surface. The system uses the elastomer transfer surface in combination with a hard transfix roller and an integrated duplex path for near perfect image transfer of the ink image onto the receiving substrate and post fusing of the media without the need for a separate fusing mechanism. Lensing of the ink image is greatly reduced on transparencies and/or gloss of the ink surface is greatly increased on paper.

Still other aspects of the present invention will become apparent to those skilled in this art from the following description, wherein there is shown and described a preferred embodiment of this invention by way of illustration of one of the modes best suited to carry out the invention. The invention is capable of other different embodiments and its details are capable of modifications in various, obvious aspects all without departing from the invention. Accordingly, the drawings and descriptions will be regarded as illustrative in nature and not as restrictive.

BRIEF DESCRIPTION OF THE DRAWINGS

The objects, features and advantages of the invention will become apparent upon consideration of the following detailed disclosure of the invention, especially when it is taken in conjunction with the accompanying drawings wherein.

DETAILED DESCRIPTION OF THE INVENTION

Figure 1:
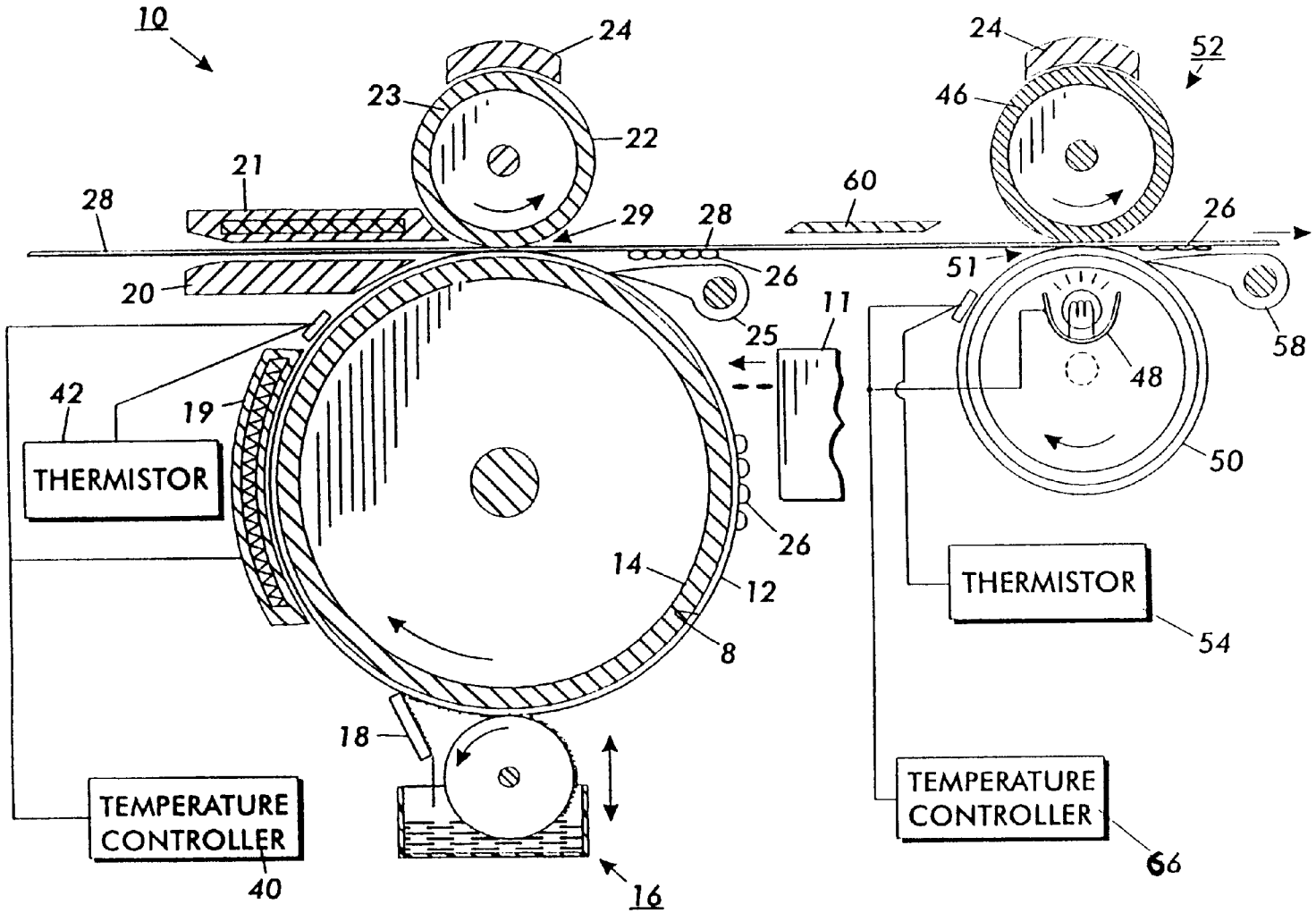
FIG. 1 is a diagrammatic illustration of present invention for applying a two-step transfix process in an ink jet printing system.
Figure 4:
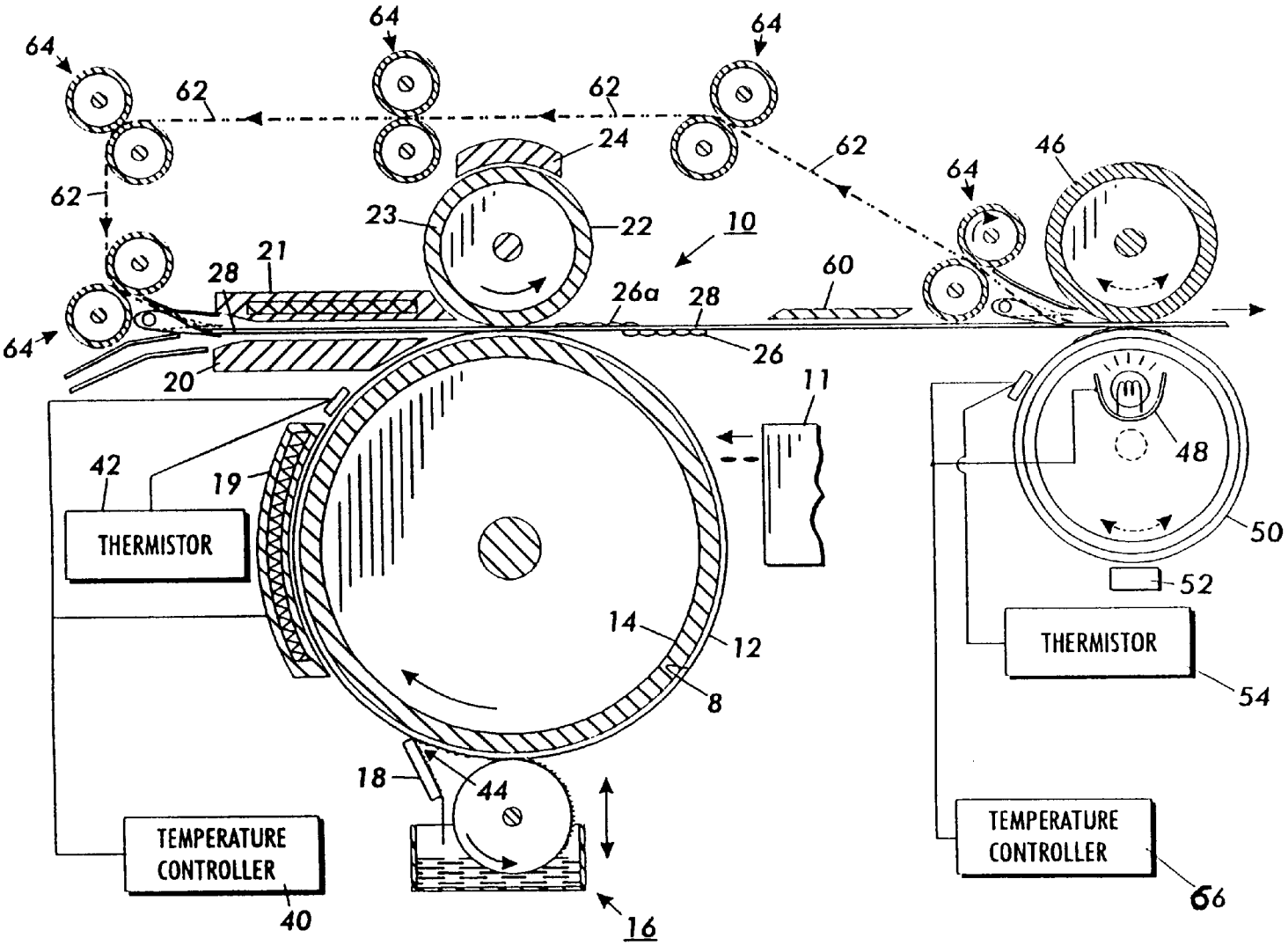
FIG. 4 is an enlarged diagrammatic illustration of duplexing the receiving substrate for re-transfixing the ink image in accordance with the present invention.

FIGS. 1 and 4 disclose a diagrammatical illustrations of an imaging apparatus 10 of the present invention for applying a two-step transfix process whereby a hot melt ink is printed onto an elastomer transfer surface for transference to a receiving substrate and then transported through a fuser for post fusing. FIG. 4 diagrammatically illustrates duplexing the receiving substrate for re-transfixing and/or finishing the hot melt ink in accordance with the present invention, as will be more fully described below. Referring to both FIGS. 1 and 4 wherein like numerals refer to like or corresponding parts throughout, there is shown a print head 11 having ink jets supported by appropriate housing and support elements (not shown) for either stationary or moving utilization to deposit ink onto an intermediate transfer surface 12. The ink utilized is preferably initially in solid form and then changed to a molten state by the application of heat energy to raise the temperature from about 85 degrees to about 150 degrees centigrade. Elevated temperatures above this range will cause degradation or chemical breakdown of the ink. The molten ink is then applied in raster fashion from ink jets in the print head 11 to the intermediate transfer surface 12 forming an ink image. The ink image is then cooled to an intermediate temperature and solidifies to a malleable state wherein it is transferred to a receiving substrate or media 28 and then is either post-fused or duplexed for retransfixing or finishing. The details of for both processes will now be more fully described below.

A supporting surface 14 which is shown in FIGS. 1 and 4 as a drum, but may also be a web, platen, belt, band or any other suitable design (hereinafter "drum 14"), is coated with an elastomer layer which defines a release surface 8. The intermediate transfer surface 12 is a liquid layer applied to the release surface 8 on drum 14 by contact with an applicator assembly 16, such as a liquid impregnated web, wicking pad, roller or the like. By way of example, but not of limitation, applicator assembly 16 comprises a wicking roller or pad of fabric or other material impregnated with a release liquid for applying the liquid and a metering blade 18 for consistently metering the liquid on the surface of the drum 14. Suitable release liquids that may be employed to form the intermediate transfer surface 12 include water, fluorinated oils, glycol, surfactants, mineral oil, silicone oil, functional oils or combinations thereof. As the drum 14 rotates about a journalled shaft in the direction shown in FIGS. 1 and 4, applicator assembly 16 is raised by the action of an applicator assembly cam and cam follower (not shown) until the wicking roller or pad is in contact with the surface of the drum 14. The release liquid, retained within the wicking roller or pad is then deposited on the surface of the drum 14. An exemplary intermediate transfer surface application system, and the details thereof, are fully disclosed in commonly assigned U.S. Pat. No. 5,805,191 to Jones et al., hereby incorporated by reference.

Figure 2:
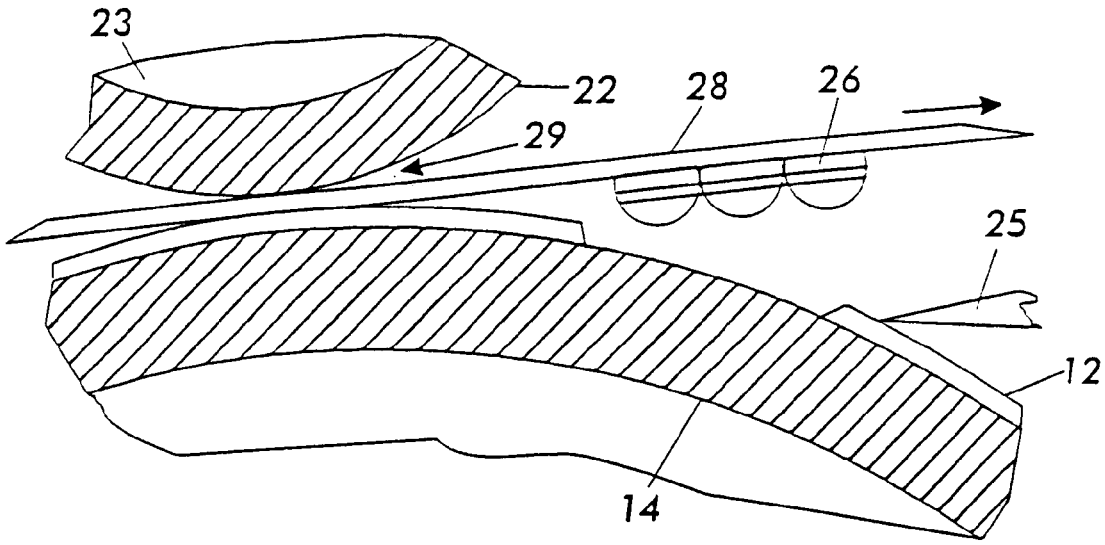
FIG. 2 is an enlarged diagrammatic illustration of the transfer of an ink image from a liquid intermediate transfer surface to a receiving substrate.

Referring once again to FIGS. 1 and 4, the release liquid that forms the intermediate transfer surface 12 on release surface 8 is heated by an appropriate heater device 19. The heater device 19 may be a radiant resistance heater positioned as shown or positioned internally within the drum 14. Heater device 19 increases the temperature of the intermediate transfer surface 12 from ambient temperature to between 25 degrees to about 70 degrees centigrade or higher to receive the ink from print head 11. This temperature is dependent upon the exact nature of the liquid employed in the intermediate transfer surface 12 and the ink used and is adjusted by temperature controller 40 utilizing thermistor 42. Ink is then applied in molten form from about 85 degrees to about 150 degrees centigrade to the exposed surface of the liquid intermediate transfer surface 12 by the print head 11 forming an ink image 26. The ink image 26 solidifies on the intermediate transfer surface 12 by cooling down to the malleable intermediate state temperature provided by heating device 19. A receiving substrate guide apparatus 20 then passes the receiving substrate 28, such as paper or transparency, from a positive feed device (not shown) and guides it through a nip 29, as shown in FIG. 2. Opposing accurate surfaces of a roller 23 and the drum 14 forms the nip 29. In one embodiment, the roller 23 has a metallic core, preferably steel with an elastomer coating 22. The drum 14 having release surface 8 continues to rotate, entering the nip 29 formed by the roller 22 with the curved surface of the intermediate transfer surface 12 containing the ink image 26. The ink image 26 is then deformed to its image conformation and adhered to the receiving substrate 28 by being pressed there against. The elastomer coating 22 on roller 23 engages the receiving substrate 28 on the reverse side to which the ink image 26 is transferred.

In this process, the ink image 26 is first applied to the intermediate transfer surface 12 on the elastomer surface 8 of the rotating drum 14 and then transfixed off onto the receiving substrate or media 28. It should be understood that the thicker the elastomer surface 8 the higher the transfer efficiency due to its ability to conform around the primary and secondary ink spots and paper roughness. A preferred thickness in accordance with higher transfer efficiency is approximately between 40 to 200 microns. It should also be understood that the thinner the elastomer surface 8 that the ink image spreads and flattens and is penetrated into the paper. A preferred thickness in accordance with a higher drop spread is approximately between 5 to 40 microns. The ink image 26 is thus transferred and fixed to the receiving substrate 28 by the pressure exerted on it in the nip 29 by the resilient or elastomeric surface 22 of the roller 23. By way of example only, the pressure exerted may be less than 800 lbf on the receiving substrate or media. Stripper fingers 25 (only one of which is shown) may be pivotally mounted to the imaging apparatus 10 to assist in removing any paper or other final receiving substrate 28 from the exposed surface of the liquid layer forming the intermediate transfer surface 12. After the ink image 26 is transferred to the receiving substrate 28 and before the next imaging, the applicator assembly 16 and metering blade 18 are actuated to raise upward into contact with the drum 14 to replenish the liquid intermediate transfer surface 12.

In another embodiment, a heater 21 may be used to preheat the receiving surface 28 prior to the transfer of the ink image 26. The heater 21 may be set to heat from between about 60 degrees to about 200 degrees centigrade. It is theorized that the heater 21 raises th e temperature of the receiving medium to between about 45 degrees to about 100 degrees centigrade. However, the thermal energy of the receiving substrate 28 is kept sufficiently low so as not to melt the ink image upon transfer to the receiving substrate 28. When the ink image 26 enters the nip 29 it is deformed to its image conformation and adheres to the receiving substrate 28 either by the pressure exerted against ink image 26 on the receiving substrate 28 or by the combination of the pressure and heat supplied by heater 21 and/or heater 19. In yet another embodiment, a heater 24 may be employed which heats the transfer and fixing roller 23 to a temperature of between about 25 degrees to about 200 degrees centigrade. Heater devices 21 and 24 can also be employed in the paper or receiving substrate guide apparatus 20 or in the transfer and fixing roller 23, respectively. The pressure exerted on the ink image 26 must be sufficient to have the ink image 26 adhere to the receiving substrate 28 which is between about 10 to about 2000 pounds per square inch, and more preferably between about 750 to about 850 pounds per square inch.

FIG. 2 diagrammatically illustrates the sequence involved when the ink image 26 is transferred from the liquid layer forming the intermediate transfer surface 12 to the final receiving substrate 28. As seen in FIG. 2, the ink image 26 transfers to the receiving substrate 28 with a small, but measurable quantity of the liquid in the intermediate transfer surface 12 attached thereto as an outer layer 27. The average thickness of the transferred liquid layer 27 is calculated to be about 0.8 nanometers. Alternatively, the quantity of transfer red liquid layer 27 can be expressed in terms of mass as being from about 0.1 to about 200 milligrams, and more preferably from about 0.5 to about 50 milligrams per page of receiving substrate 28. This is determined by tracking on a test fixture the weight loss of the liquid in the applicator assembly 16 at the start of the imaging process and after a desired number of sheets of receiving substrate 28 have been imaged.

Figure 3:
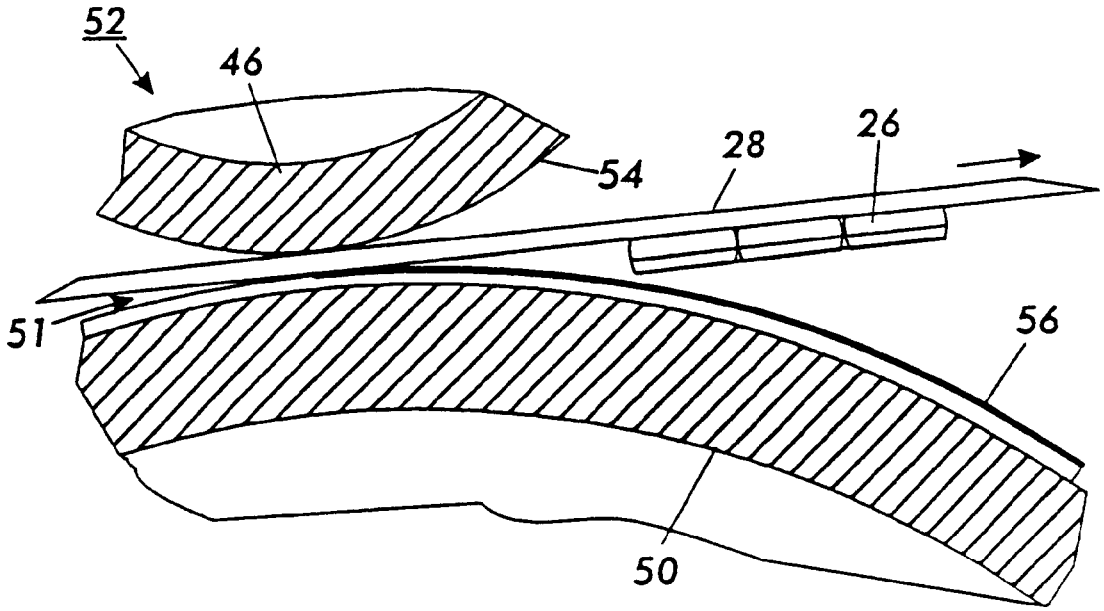
FIG. 3 is an enlarged diagrammatic illustration of the fusing of the ink image into the receiving substrate by secondary fusing.

After exiting the nip 29 created by the contact of the roller 23 and the elastomer layer 8 and drum 14, the ink image can then be thermally controlled with a thermal device 60. This thermal device 60 can heat, cool, or maintain the temperature of the receiving substrate 28 and ink image 26 which may by way of example be between 50 to 100 degrees C. The highest temperature the receiving substrate 28 and ink image 26 can be increased to in this location is dependent on the melting or flash point of the ink and/or the flash point of the receiving substrate 28. The thermal device 60 could be as simple as insulation to maintain the temperature of the ink and substrate as it exits the nip 29, or a heating and/or cooling system to add or remove thermal energy. The receiving substrate 28 and ink image 26 are then transported to a fuser 52. Referring to FIG. 3, the fuser 52 is composed of a back-up roller 46 and a fuser roller 50. The back-up roller 46 and fuser roller 50 have metallic cores, preferable steel or aluminum, and may be covered with elastomer layers 54 and 56, respectively. The back-up roller 46 engages the receiving substrate 28 and ink image 26 on the reverse side to which the ink image 26 resides. This fuses the ink image 26 to the surface of the receiving substrate 28 so that the ink image 26 is spread, flattened, penetrated and adhered to the receiving substrate 28, as is shown in FIG. 3. The pressure exerted by the fuser may be between 400 lbf to about 2000 lbf by way of example.

When the receiving substrate 28 and ink image 26 enter the fuser 52 their temperature will change as determined by the transient heat transfer of the system during the dwell in a nip 51 formed by the fuser roller 50 and the back-up roller 46. Depending on the temperature of the back-up roller 46 and fuser roller 50, the transient temperature of the receiving substrate 28 and ink image 26 throughout their thickness can be controlled by either quenching or hot fusing. If the receiving substrate 28 and ink image 26 are brought into the fuser nip 51 hotter than the fuser roller 50 and the back-up roller 46, the ink image 26 will be quenched to a cooler temperature. This is referred too as quench fusing. If the receiving substrate 28 and ink image 26 is brought into the fuser nip 51 cooler than the fuser roller 50 and the back-up roller 46, the ink image 26 will be heated to a higher temperature, say between 75–100 C. This is referred to as hot fusing. This process allows pressure to be applied to the receiving substrate 28 and ink image 26 at temperatures unachievable in the first nip 29. This is done by quenching the receiving substrate 28 and ink image 26 from a high temperature, say 80–85 C down to a lower temperature, say 55–65 C where the ink image 26 has enough cohesive strength to remain intact as it exits the fuser.

Additionally, the above fusing process may also be accomplished by heating the secondary fuser nip 51 such that the ink image 26 near the surface of the receiving substrate 28 is hotter than the ink image near the surface of the fuser roller 50. This allows cool enough ink temperatures for release from the fuser roller 50 and higher temperatures near the receiving substrate 28, which increase spread, flattening, penetration and adhesion. In the case that the fuser roller 50 is a belt instead of a roller, the receiving substrate 28 and ink image 26 can be held against the belt for a distance past the nip 51 formed by the secondary fuser 50 and back-up roller 46. This allows the ink sufficient time to cool to a temperature low enough to allow it to be stripped from the belt. It should be understood that the temperature of the fuser 52 can be different to that of the receiving substrate 28 and ink image 26 and is controlled with a separate control system 56 consisting of a heater 48, and thermistor 54, as is shown in FIG. 1. Stripper fingers 58 (only one of which is shown) may be pivotally mounted to the fuser roller 50 to assist in removing any paper or receiving substrate from the surface of the fuser roller 50. The ink image 26 then cools to ambient temperature where it possesses sufficient strength and ductility to ensure its durability.

Referring to FIG. 4, there is shown another embodiment wherein instead of fusing the receiving substrate 28 in a secondary fuser 52, the ink image 26 is re-transfixed or finished to the receiving substrate 28. "Re-transfixed" is defined as actual increased image spread and/or penetration into the media. "Finishing" is defined as increases in droplet flatness (or reduction of hemispherical droplets) and/or decreases in overall image surface roughness. Finishing is performed in order to reduce lensing of the drops, which reduces light loss for improved overhead transparencies.

Flatter and/or smoother ink surfaces also allow higher levels of gloss on paper media. In this embodiment the rollers 46 and 50 act to pull back the receiving substrate 28 through duplex path 62 by the use of a plurality of duplex rollers 64. By duplexing the receiving substrate 28 the ink image 26 now faces the transfix roller. In accordance with the present invention, in order to greatly reduce ink surface roughness and hemispherical droplets which reduce paper gloss and transparency haze, the transfix roller 22 is polished aluminum wherein the receiving substrate is passed through the first nip 29 a second time to re-transfix the ink image 26.

In summary, the present invention utilizes soft drum with a hard roller for near perfect image transfer and greatly reduced image roughness or increased pixel flatness which reduces lensing in transparencies or increases gloss in paper. These two steps separate the requirements of ink transfer and ink spreading, topography, and penetration into the paper and will be easier to optimize for life than a single step transfix system that must perform both operations.

While the invention has been described above with reference to specific embodiments thereof, it is apparent that many changes, modifications and variations in the materials, arrangements of parts and steps can be made without departing from the inventive concept disclosed herein. Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

What is claimed is:

1. A method for controlling transparency haze in an ink jet printer, the method comprising the steps of:

a) forming an ink image on an intermediate transfer surface;

b) passing a final receiving substrate through a first nip;

d) exerting a first pressure and temperature on the final receiving substrate in the first nip to transfer the ink image from the intermediate transfer surface to the final receiving substrate;

e) passing the final receiving substrate through a second nip; and f) pulling the final receiving substrate back through a duplex path; and g) exerting a second pressure on the final receiving substrate in the first nip for re-transfixing the ink image to decrease image roughness and reduce lensing.

2. The method of claim 1, wherein the step of passing the final receiving substrate through a first nip is between a hard roller and a soft drum.

3. The method of claim 2, wherein the hard roller is an aluminum transfix roller.

4. The method of claim 2, wherein the soft drum is a drum with a compliant layer having a coating defining an intermediate transfer surface thereby defining a release surface.

5. The method of claim 1, wherein the step of exerting the second pressure on the final receiving substrate has the ink image facing toward the aluminum transfix roller.

6. The method of claim 1, wherein the step of passing the final receiving substrate through a first nip is defined by opposing surfaces of a transfer roller and the intermediate transfer surface wherein the intermediate transfer surface is heated by a heater device.

7. The method of claim 1, wherein the step of exerting the first pressure comprises the step of exerting less than about 800 lbf on the final receiving substrate.

8. The method of claim 1, further including the step of heating the final receiving substrate to a temperature of between about 40 C and about 100 C after transferring the ink image to the final receiving substrate and prior to passing the final receiving substrate through the second nip.

9. The method of claim 1, wherein the step of passing the final receiving substrate comprises a paper through the first nip.

10. The method of claim 1, wherein the step of passing the final receiving substrate comprises a transparency through the first nip.

11. An apparatus for applying a two step transfix process in an ink jet printer, the printer having a print head mounted thereon for applying phase change ink image-wise to an intermediate transfer surface, the apparatus comprising: an applicator assembly connected to the printer adjacent to a support surface for distributing a liquid layer onto the support surface to produce the intermediate transfer surface; means for applying phase change ink to the intermediate transfer surface; means for transferring the phase change ink from the intermediate transfer surface to a receiving medium; and re-transfixing the receiving medium using a duplex path for reducing lensing.

12. The apparatus according to claim 11, wherein the step of passing the receiving medium through a first nip is between a hard roller and a soft drum.

13. The apparatus according to claim 12, wherein the hard roller is an aluminum transfix roller.

14. The apparatus according to claim 12, wherein the soft drum is a aluminum drum with a compliant layer having a coating defining the intermediate transfer surface thereby defining a release surface.

15. The apparatus according to claim 11, wherein re-transfixing the receiving medium using a duplex path for reducing image roughness and lensing has the ink image facing toward the aluminum transfix roller.

16. The apparatus according to claim 11, wherein means for transferring the phase change ink from the intermediate transfer surface to a receiving medium is through a first nip defined by opposing surfaces of a transfer roller and the intermediate transfer surface wherein the intermediate transfer surface is heated by a heater device.

17. The apparatus according to claim 11, wherein means for transferring the phase change ink from the intermediate transfer surface to a receiving medium exerts less than about 800 lbf on the final receiving substrate.

18. The apparatus according to claim 11, wherein the receiving medium is paper.

19. The apparatus according to claim 11, wherein the receiving medium is a transparency.

20. A ink jet print application system comprising:

means for forming an ink image on a intermediate transfer surface;

means for passing a final receiving substrate through a first nip;

means for exerting a first pressure and temperature on the final receiving substrate in the first nip to transfer the ink image from the intermediate transfer surface to the final receiving substrate;

means for passing the final receiving substrate through a second nip; and means for pulling the final receiving substrate back through a duplex path; and means for exerting a second pressure on the final receiving substrate in the first nip for re-transfixing the ink image to reduce lensing.

* * * * *